United States Patent [19]

Galanto et al.

[11] Patent Number: 4,611,355

[45] Date of Patent: Sep. 16, 1986

[54] CONVERTIBLE PATCHES FOR APPAREL

[76] Inventors: Charles Galanto, Box 15741, Honolulu, Hi. 96815; Charles R. Lundy, 59-787C Kam Hwy., Haleiwa, Hi. 96712

[21] Appl. No.: 671,956

[22] Filed: Nov. 16, 1984

[51] Int. Cl.[4] ..... A42B 1/24

[52] U.S. Cl. ..... 2/246; 2/199

[58] Field of Search ..... 2/115, 246, DIG. 6, 2/199, 209.1, 185 R, 186; 40/140, 129

[56] References Cited

U.S. PATENT DOCUMENTS

| | | | |
|---|---|---|---|
| 3,484,974 | 12/1969 | Culmone | 2/115 |
| 3,596,291 | 8/1971 | Thill | 2/245 |
| 3,895,797 | 7/1975 | Moore | 2/185 R |
| 4,106,126 | 8/1978 | Traekle | 2/DIG. 6 |
| 4,173,042 | 11/1979 | Krzewinski-Morris | 2/197 |
| 4,304,005 | 12/1981 | Danley, Sr. | 2/199 |
| 4,312,076 | 1/1982 | Gamm | 2/199 |
| 4,378,009 | 3/1983 | Rowley et al. | 128/83 |
| 4,428,101 | 1/1984 | Harkavy | 24/117 |

*Primary Examiner*—Doris L. Troutman

*Attorney, Agent, or Firm*—Hall, Myers & Rose

[57] ABSTRACT

Disclosed is a novel application of VELCRO-type fasteners, apparel and indicia bearing patches to provide combinations and methods for interchangeability of patches on apparel and convertibility of the identifying patches.

2 Claims, 3 Drawing Figures

CONVERTIBLE PATCHES FOR APPAREL

TECHNICAL FIELD

This invention relates to convertible patches for apparel. More particularly, this invention addresses the use of VELCRO-type fasteners directed to attaching, in a removable manner, indicia bearing patches to apparel.

BACKGROUND OF THE INVENTION

Indicia bearing patches, being symbols of association and preferences, grow ever more popular. The popularity of patches as identifying symbols cannot be denied and patches themselves have evolved with the advent of new technologies. For example, patches now incorporate synthetic fibers, fluorescent dyes, diodes, and even liquid crystals to impart unique qualities, appearances and uses. The identification nature of patches ranges from conservative motor vehicle hat patches to elaborate and even outrageous configurations often displayed on garments worn by teen-age adolescents.

As a result of the host of subjects found in emblazoned on patches, e.g. sports teams, popular bands, community organizations, an individual who is associated with a variety of groups will own a variety of similar apparel bearing different patches. This redundancy of similar articles of apparel is mandated by the nature of patches and the manner of their attachment. Where an individual identifies with only a few organizations, permanent attachment of the patches to apparel is perfectly suitable. However, were a person is a wearer of many hats, the permanent attachment of the patches can generate a multiplicity of like articles. For example, a sports fan who attends a baseball game in the afternoon and a stock-car race in the evening, will bring two hats attached to which are patches bearing the respective symbols of the preferred teams.

In view of the technological advances relating to spectrum of aspects associated with indicia-bearing patches, it is surprising that no advances in the art of attaching said patches to apparel has been developed.

SUMMARY OF THE INVENTION

It is, therefore, an object of this invention to provide a novel combination of apparel and indicia-bearing patches which are interchangeable on the apparel.

It is a further object of this invention to provide an attachment means for indicia-bearing patches on apparel which permits patches to be positioned and removed at will.

These and other objects of the invention are satisfied by a combination including a VELCRO-type fastener characterized by a first and a second layer, said first layer incorporating a pile of loosely-woven minute loops and a second layer incorporating projecting minute hook-like structures which when juxtaposed and pressed together cooperate and releasably attach to one another. Further incorporated in the combination is an article of wearing apparel a portion of which comprises either one or the other layer of the fastener material and an indicia bearing patch having a first and a second face, the first face bearing indicia and the second including the other cooperating fastener layer whereby the patch may be releasably attached to the apparel.

This invention, in view of the foregoing, provides a convertible patch system for a single article of clothing. An indicia-bearing patch having incorporated thereon one part of VELCRO-type fastener can be easily attached and removed from apparel bearing the complementary VELCRO-type layer which either forms a portion of or is permanently attached to that article. Therefore, the single article of apparel has the capacity to bear a myriad of patches or even other cooperating entertaining or functional devices without damage to the clothing from repeated attachment and detachment therefrom.

Thus, this invention, although not specifically contributing to the appearance or quality of the identifying nature of patches and apparel, does provide a novel and effective combination enhancing the dislay thereof. Furthermore, the invention provides convertibility and greater flexibility for the user, particularly in the context of simultaneous display of multiple patches. These and other aspects of the invention will become apparent to the skilled artisan upon review of the following description.

DETAILED DESCRIPTION OF THE INVENTION

Although applicable to a host of apparel such as hats, coats, shirts, pants, gloves, visors, etc., the preferred embodiment of the invention will be described in the context of a baseball-type cap. This description is not intended to be limiting the invention but merely illustrative.

Figure 1:
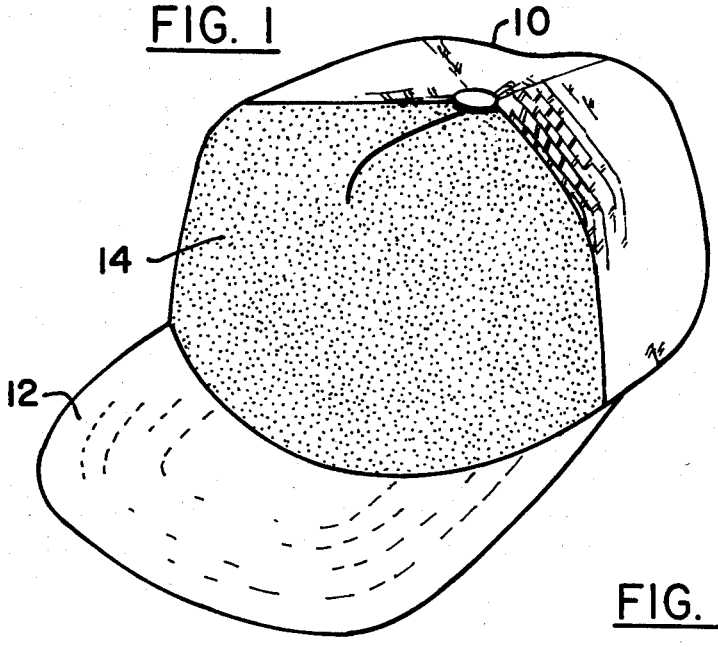
FIG. 1 is a perspective view of a baseball-type cap in accordance with this invention.

Cap 10 is illustrated as having visor 12 and large area 14 on the front portion of cap 10 which is formed from a woven textile material of a VELCRO-type pile. The VELCRO-type pile is composed of a mass of tiny woven eyelets which are more fully described in U.S. Pat. Nos. 2,717,437 and 3,000,925 issued to George de Mestral and which are incorporated herein by reference. Pile layer 14 may either be formed as an integral portion of the cap's structure or may be permanently attached to an already existing cap 10. In FIG. 1 of the preferred embodiment of the invention, the entire front portion of cap 10 includes outer pile layer 14 whereby the wearer may simultaneously display a multiplicity of patches. It is apparent, however, that just a small portion of cap 10 or the entire outer surface thereof, including the visor, may be composed of pile layer 14.

Figure 2:
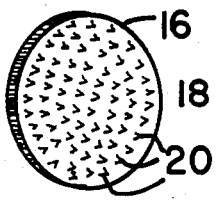
FIG. 2 is a perspective view of the backside of a patch in accordance with this invention.

Patch 16, more clearly depicted in FIG. 2, includes an indicia bearing face (not depicted), and VELCRO-type hook layer 18 permanently attached to the backface. Layer 18 is characterized by a mass of tiny projecting hook-like structures 20. The structures are further described in the above-referenced patents. Layer 18 is attached to patch 16 by various conventional means such as sewing or glueing. It should be noted that ironing or affixation with hot-melt adhesives may be undesirable due to the possible destruction of projecting hooks 20. Again, like pile layer 14 located on cap 10, it is possible to modify the size of the area of patch 18 affixed to the back of patch 16. However, it is preferable that the entire back surface of indicia-bearing patch 16 be covered with hooks 20 in order to ensure complete affixation of patch 16 to pile layer 14.

Figure 3:
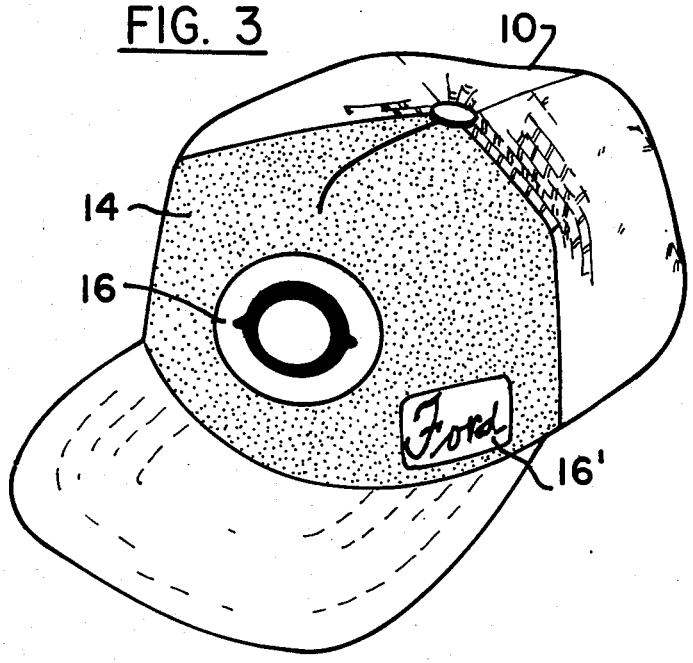
FIG. 3 is a perspective view of the baseball-type cap bearing patches in accordance with this invention.

Turning now to FIG. 3, patch 16 is affixed to the central portion of layer 14. Attaching patch 16 to cap 10 merely requires that patch 16 be properly positioned and juxtaposed on layer 14 and pressed thereon. Coacting hooks 20 penetrate pile 14 engaging and hooking onto the woven loops in a releasable manner. Separating patch 16 from pile layer 14 involves no more than firmly grasping the patch and pulling with sufficient force to overcome the gripping force of the coacting VELCRO-type fastening layers. The capacity for placing one or a multiplicity of patches on a similar hat underscores the flexibility of the attachment system proposed by this invention.

Contemplated among the alternative embodiments is reversing the relative position of the fastener components which will not affect the efficacy of the attachment method. Additionally, an entire article may be composed of the pile layer. For example, a cap so composed, is lightweight, provides sufficient ventilation and possesses adequate structural integrity. Yet another variation involves the VELCRO-type fasteners for attachment of various other articles to apparel such as entertainment devices, e.g. beanies, costume features, etc. and functional devices, e.g. flashlights, reflectors, sunglasses, etc.

These and other embodiments, variations and modifications should now be apparent to the skilled artisan and are intended to fall within the scope of the following claims.

I claim:

1. In combination, (a) a cap consisting of a hemispherical head covering portion with a substantially circular lower edge and first and second half sections, each section being of substantially similar size and being so connected to form an integral unit, and a substantially rigid visor member having an arcuate back edge, said visor member extending substantially orthogonally from the lower edge of said first section, said visor member having an upper and lower surface, and said back edge being connected to and substantially coextensive with said first section, and the outer surface of said first section and visor member consisting essentially of a layer of a multitude of minute woven loops, (b) a plurality of patches having a first surface bearing indicia and a second surface opposite said first surface, where said second surface consists essentially of a multitude of minute hooks, and (c) where said loop layer and said hooked surface constitute coacting components of a separable fastener upon juxtaposing and pressing said hook surface onto said loop layer whereby the patches are removable fastened to said loop layer, and where a plurality of indicia are simultaneously displayable on said cap.

2. A cap for attaching articles having minute hooks thereon, comprising:

(a) a first section having an upper edge and a lower edge consisting essentially of a layer of a multitude of minute woven loops and a second section where the first section and second section are so connected to define a hemispherical outline with a substantially circular lower edge, and the first section intersects with the apex of the hemisphere, and (b) a visor member having upper and lower surfaces each consisting essentially of a layer of minute woven loops, said visor having an arcuate back edge, which is essentially coextensive with and attached to said lower edge of said first section.

* * * * *